US006799701B2

(12) United States Patent
Weiperth

(10) Patent No.: US 6,799,701 B2
(45) Date of Patent: Oct. 5, 2004

(54) PACKAGING UNIT FOR THE STORAGE AND DISPENSING OF LIQUIDS, FLUID AND DUCTILE MATERIALS

(76) Inventor: Vilmos Weiperth, H-2315 Szigethalom, Vasvári Pál U. 6 (HU)

( * ) Notice: Subject to any disclaimer, the term of this patent is extended or adjusted under 35 U.S.C. 154(b) by 0 days.

(21) Appl. No.: 10/415,901

(22) PCT Filed: Oct. 27, 2001

(86) PCT No.: PCT/HU01/00104

§ 371 (c)(1),
(2), (4) Date: Oct. 8, 2003

(87) PCT Pub. No.: WO02/36457

PCT Pub. Date: May 10, 2002

(65) Prior Publication Data

US 2004/0065691 A1 Apr. 8, 2004

(30) Foreign Application Priority Data

Nov. 3, 2000 (HU) ..... 0004261

(51) Int. Cl.[7] ..... B65D 83/54

(52) U.S. Cl. ..... 222/158; 222/402.13; 222/402.15; 222/402.2; 222/402.24; 222/389

(58) Field of Search ..... 222/158, 389, 222/402.1, 402.13, 402.15, 402.2, 402.24

(56) References Cited

U.S. PATENT DOCUMENTS

| | | | | |
|---|---|---|---|---|
| 2,746,797 A | | 5/1956 | Remane | |
| 3,132,570 A | | 5/1964 | Hoffman, Jr., et al. | |
| 3,146,916 A | * | 9/1964 | Kronheim | 222/402.13 |
| 3,547,147 A | * | 12/1970 | Shay | 222/402.24 |
| 3,606,088 A | * | 9/1971 | Baltzer | 222/402.24 |
| 4,171,757 A | * | 10/1979 | Diamond | 222/389 |
| 5,419,466 A | * | 5/1995 | Scheindel | 222/389 |
| 5,573,137 A | * | 11/1996 | Pauls | 222/389 |
| 6,244,475 B1 | * | 6/2001 | Walz et al. | 222/389 |
| 6,386,400 B1 | * | 5/2002 | Scheindel | 222/389 |
| 2002/0030067 A1 | * | 3/2002 | Frutin | 222/389 |

FOREIGN PATENT DOCUMENTS

| | | |
|---|---|---|
| CH | 636 822 | 6/1983 |
| HU | PS 182917 | 3/1984 |
| HU | PS 213355 | 1/1997 |
| HU | PS 214254 | 4/1997 |
| WO | WO 99 18010 | 4/1999 |

* cited by examiner

*Primary Examiner*—Kenneth Bomberg
(74) *Attorney, Agent, or Firm*—Young & Thompson

(57) ABSTRACT

A packaging unit has a cartridge for storing material and pressurized gas operating with it and a dispensing head connected to the cartridge. A sliding piston is positioned in the internal space of the cartridge, the piston divides the internal space into a product chamber and a pressurized gas chamber that have a gas-tight seal between them. A plug is fitted into the pressurized gas chamber end of the cartridge and a valve to the product chamber end, the valve has a valve house, a valve stem, and a disc spring with plate segments. The valve stem has a discharge opening at the end coming out of the cartridge, the end in the product chamber of the cartridge has a conical surface, the plate segments of the disc spring are pushed up against the conical surface of the valve stem, while the disc spring is snapped onto the valve house.

7 Claims, 3 Drawing Sheets

Figure 1:
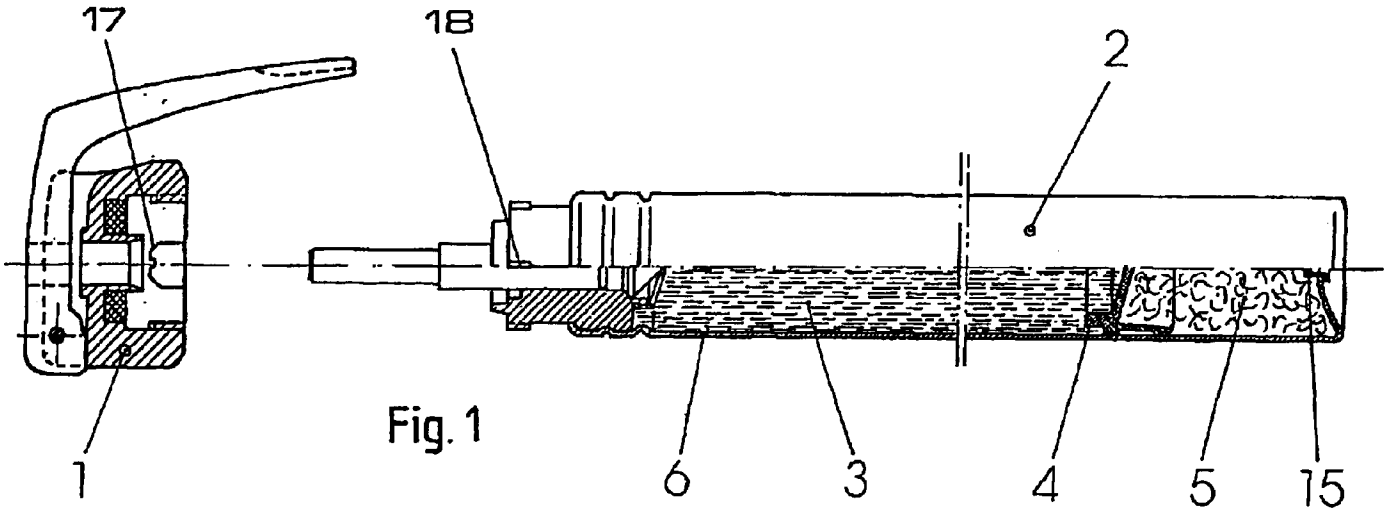

PACKAGING UNIT FOR THE STORAGE AND DISPENSING OF LIQUIDS, FLUID AND DUCTILE MATERIALS

The subject of the invention relates to a packaging system in which "liquids" or "cream-like materials" may be pushed out of a cartridge that is connected to a dispensing head, as a result of the pressurised gas in the cartridge.

The dispensing head contains a valve-opening lever, and the cartridge contains a valve mechanism on its connection side, and, inside it, a product chamber and an elastic piston and pressurised gas chamber. The dispensing head and the cartridges have the same connection elements, which make it possible to quickly interchange the cartridges containing the liquid and cream-like material. The product that remains in the disconnected cartridge is stored there until it is next used.

Numerous solutions are known for the packaging and dispensing of small amounts of materials manufactured by the chemical industry. The most widely used solution for the packaging and atomisation of liquids is the conventional AEROSOL solution. At the beginning of the 1980s in the scope of the "UN Environmental Protection Program" the leading body of UNEP (United Nations Environmental Program) ordered—for the protection of the ozone layer that protects the atmosphere of our planet—the prohibition of FREON gas products. Taking into consideration that in that time AEROSOL products used FREON gas, the industry had to find another solution. Henceforward the similar propane butane (PB) gas was used. PB gas, as FREON gas before it—is used in carrier gas atomisation systems. The essence of this is that both the liquid to be sprayed out and the liquid PB gas—in other words the carrier gas—are filled into the metal container at the same time. In the container a proportion of the PB gas falls under the critical pressure and due to this it goes into the gas state and so exerts pressure on the top of the liquid and aids atomisation. While at the same time the rest of the liquid PB gas in a liquid state forms a mixture with the liquid, and on leaving the atomisation opening—as a result of the reduction in pressure—it significantly increases the quality of the atomisation. This system commonly known as an AEROSOL system, in other words: carrier gas system results in fine liquid atomisation. An advantage of this system is that the pressure in the container—and due to this the quality of the atomisation—is continuous, because the change of state of the PB gas takes place at the permanent critical pressure. Its disadvantage is that PB gas also flows out of the nozzle, which may involve a danger of explosion in the immediate vicinity and it is unhealthy if it comes into contact with the human body. It is also important to mention that the container cannot be operated in an upside down position.

The most commonly used method of dispensing creams is the so-called "pump system". The essence of this is that the liquid cream gets into the "antechamber" of a push-button valve, and when the button is pushed down the ball valve at the bottom part of the antechamber closes and so the small amount of cream in the "antechamber" flows out, then when the push-button is released the next portion is sucked up into the "antechamber". This "pump" solution is also used with liquids, on the atomisation of small amounts of liquids, with a very good degree of efficiency (e.g. in the cosmetics industry). Its advantage is the repeated dispensing of small amounts. Its disadvantage is that only creams with a very low degree of thickness may be pumped out of it and that it may not be operated whilst upside down.

In the following patent descriptions are presented that related to the solution that forms the subject of the application:

Pat. No. DE 2912670 contains a spray-bottle solution, in which inside a container that forms a closed unit the liquid to be sprayed out is contained in a film pipe closed at the bottom and the upper edge of the pipe is fixed to the upper edge of the container and also to the upper closing cover, which cover also contains the atomising valve. The filling of the pressurised gas takes place at the bottom part of the container. The solution is a "pressurised gas" system, in which the pressurised gas exerts an indirect effect on the liquid and when the valve is opened the liquid is atomised. An advantage is that it may also be used when upside down. As the film pipe shrinks a situation may occur when the path of the liquid is blocked. Patent CH 672476 can be viewed as being the same as the invention analysed above as regards its structural form with the difference that the film sack contains cream. The operation of the device according to the patent is also similar to the previous one. On opening the valve the cream or paste-like material flow out freely. In this case the blockage due to the shrinkage of the film sack may occur more frequently.

U.S. Pat. description No. 5,065,900 contains a closed system, metal spray container which is of the "pressurised gas" type and the material dispensed is a liquid. Between the material to be atomised and the pressurised gas there is a piston. The pressurised gas exerts a force on the liquid indirectly through the piston and when the valve is opened the liquid inside the metal container is atomised. The advantage of the solution is that it may also be used when upside down.

Patent No. HU 182 917 contains a container solution. The liquid to be atomised is stored in a closed pipe and the pressurised gas necessary for the atomisation is contained in a cartridge connected to this. The liquid-pipe and the gas cartridge form a packaging unit, and this is placed in a "container", or, hi other words, an accepting device. After being placed inside the contained forms a closed unit. At the bottom of the container there is a piercing pin and by pressing it in the gas in the cartridge flows out and with the piercing of the pipe the path of the liquid becomes free. On pressing the atomisation valve the liquid is atomised due to the effect of the pressurised gas. After the liquid has been emptied only the pipe and cartridge unit needs to be replaced. The complete unit may also be operated when upside down. A disadvantage of it is that the pipe and cartridge unit may only be replaced by carrying out several movements.

Pat. description No. DE 39 13 851 contains a "pump" solution which is also presented at the beginning of this description with the difference that the presented patent is suitable for the dispensing of a larger amount of cream and is of a container construction. The cream or paste-like material in the film sack that is closed at the bottom is placed in the lower sheath part of the container. The upper part containing the pump assembly is screwed onto the lower part containing the film sack. By depressing the push button on the upper structural unit the piston in the upper structural unit gets into its lower position and by releasing the push button the piston sucks up the cream-like material into the antechamber. Following this, by depressing the push button again the cream flows out of the dispensing opening. From this point on the process is repeated. When the cream has run out only the film sack filled with cream needs to be replaced. It is also suitable for the spraying of liquids, in this case the whole upper part needs to be replaced, the structural part of which now has an atomisation assembly. The packaging device may also be operated while upside down. Its disadvantage is that it is structurally made up of numerous components and so its manufacture is costly.

From the analysis of the above inventions it maybe determined that the dispensing openings of the containers are constructed in accordance with the character of the given material (liquid or cream), in other words it is not possible to dispense both liquid and cream-like material from devices of the same construction. Even with the last German patent it is only possible to spray out or dispense liquid and cream if significant structural changes are made.

Due to the disadvantages of the solutions presented the task presents itself to create a packaging system from which both "liquids" and "cream-like materials" can be atomised or dispensed, that can be used in any position and, furthermore, that pushes out all of the "product" in the container and that is of a simple construction.

The packaging system according tot he invention solves the task by separating the dispensing unit and the container (or cartridge) containing the "product" and "pressurised gas" and so it may be ensured that both the "liquid" and the "cream-like material" can be dispensed. Furthermore, between the "product" and the pressurised gas" in the container (or cartridge) there is an elastic piston, and through this the device may be operated in any position and the elastic piston is formed in such a way that the "product" in the container is entirely dispensed. The packaging system is of a simple construction.

The interpretation of the collective nouns used in the description:

| | |
|---|---|
| Liquids, paints | General name: "liquids" |
| Liquid materials and ductile materials, (e.g. cream, jelly, emulsion, paste, etc.) | General name: "cream-like materials" |
| For foodstuffs (e.g. liquids, creams, pulpy materials, etc.) | General name: "foodstuffs" |
| Liquids, creamy materials, foodstuffs | General name: "products" |

The recommended minimum internal pressure values for the "products" of different consistency in the cartridges:

| | |
|---|---|
| For the atomisation of "liquids": | 5–7 bar |
| For the dispensing of "cream-like materials": | 0.3–2.2 bar |
| For the dispensing of "foodstuffs": | 0.2–0.8 bar |

It is practical to determine the ratio of the size of the "product chamber" and the "pressurised gas" chamber in the filled cartridge at 5:1. It is practical to determine the filling pressure in the cartridge while observing the recommended minimum pressure value.

The packaging system according to the invention consists of two main parts; the dispensing head and the cartridges that may be connected to it. The cartridges—in the connection side—have a built-in valve and its internal space contains the "product" to be dispensed and the "pressurised gas". The dispensing head and the cartridges have the same connection elements, where on connection the profiles fit each other and are fixed with a snap due to that the end face part of the valve house is a double cone and its surface finishes at an edge, which edge is pushed into the rubber ring inside the dispenser house, and this exerts a springing effect.

A construction form of the packaging system is when the dispensing head has a valve-opening level, and the cartridge has a valve, "liquid" inside it, a piston and pressurised gas, and both of them have the same connection elements. On its connection side the cartridge has a valve stem a part of which sticks out—which is practical to call a discharge pipe—and in the beginning of which the spin chamber atomiser insert is clicked. On the internal end face of the spin chamber atomiser insert there are 3–4 tangentially positioned grooves, and in the middle there is an atomiser bore. On a further part of the valve stem there is a shoulder formation and it is on this that the valve-opening lever rests after connection. On a further part of the valve stem there is a "O" ring in a groove. After this again there is a shoulder formation with an "0" ring, and this rests in the valve seat of the valve body on closing. There are cross-directional bores or cross-directional grooves between the two "0" rings on the valve stem from which an axial gap or bore hole runs to the discharge pipe. The valve stem ends in a 90° cone. A plastic disc spring is attached to this cone, and on the end face of this spring there are gaps and the gaps start out from the central part and the plate segments that are formed in this way exert a spring effect when the valve stem is moved axiatty. The plastic disc spring is snapped onto the seat made for it on the valve htfuse. Inside the valve house there is an axial bore hole and a valve seat formed on it which are connected to the valve stem and the "O" rings on the valve stem ensure the seal.

On the external cylindrical surface of the valve house there are groove formations. The cartridge house that is made, in a practical case, using the cold extraction method is connected to this section of the valve house. The cartridge house is fixed onto the valve house with burnishing and flanging after the piston has been placed and the liquid filled in the cartridge house. The piston in the cartridge house is of soft plastic and is made with a thin wall in the sealing section. In this section, on the external mantle there are two or more edge-like formations and the 'tips of these ring edges—due to the effect of the pressurised gas in the cartridge—stick to the internal cylinder surface of the cartridge house and ensure the appropriate seal. The filling up of the cartridge with pressurised gas takes place through the narrow bore hole in the lower part of the cartridge. After filling it is closed using a small plastic plug.

In a different construction example of the packaging system the dispensing head has a valve-opening lever, the cartridges have a valve, "cream-like material" inside them, a piston and pressurised gas. In this case also the dispensing head is completely identical, as is the structural formation of the cartridge, or rather there is a slight change that results in a favourable function-effect from the point of view of the "cream-like material" as compared to the "liquid" cartridge. Such a change is that with the depressing and releasing of the valve-opening lever a small amount of product may be dispensed from the cartridge, and if the lever is half depressed the flow of product is continuous. The dispensing of small amounts of product can be achieved by applying a shoulder formation at the 90° part of the valve stem, which shoulder—when the valve-opening lever is depressed—hits against the internal surface of the plastic disc spring and due to this the flow path of the cream-like material is blocked. The bore hole of the valve stem—at the discharge pipe end is completely open, and ensures free flow. The other aspect that results in a favourable effect is that due to the lower internal pressure the cartridge house may also be made of transparent plastic and, if necessary, may be marked in "millilitres (ml)". The filling takes place in the same way, first the piston is placed in the plastic cartridge house, then the filling of the cream-like material follows, and finally, following filling with pressurised gas the filling opening is closed by plastic welding.

Another construction form of the packaging system is when it is used for "foodstuffs" materials. In this case the dispensing head is in the "form of a mouth" and can be slipped onto the beginning of the food-cartridge easily. In this arrangement the shoulder part of the valve stem hits up against the internal surface of the dispensing head, then on the further part of the valve stem there is an "O" ring seal and this is followed by a slightly conical part. This conical part ensures the sealing when the valve is closed. There are bore holes in the slightly conical part which are at right angles to the axial direction and these run into a blind hole, which bore hole runs axially through the discharge pipe. In this case also the valve stem ends in a 90° cone, the tip of which points in the direction of the food chamber. The segment plates that ensure the closing of the valve lie on the 90° cone. The plastic disc spring is snapped onto the groove in the part of the valve house that sticks out. The valve house is connected to the transparent plastic cartridge house and afterwards it is closed using plastic welding. When it is filled first the elastic piston is fitted in then comes the foodstuff. This is followed by filling with pressurised gas and the filling opening is then closed using plastic welding.

The packaging system according to the invention is presented using the examples outlined in the drawings:

FIG. 1 The dispensing head and the cartridge are shown in a disconnected state. The cartridge is filled with "liquid". The dispensing head is shown in cross section and the cartridge is shown in half cross section.

Figure 2:
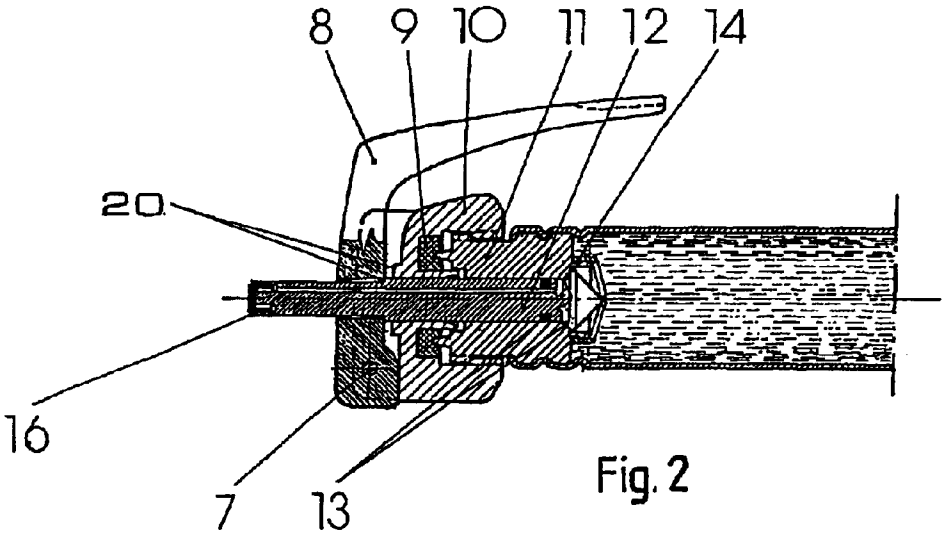

FIG. 2 The dispensing head and the cartridge are depicted connected, in cross section. The cartridge is filled up with "liquid".

Figure 3:
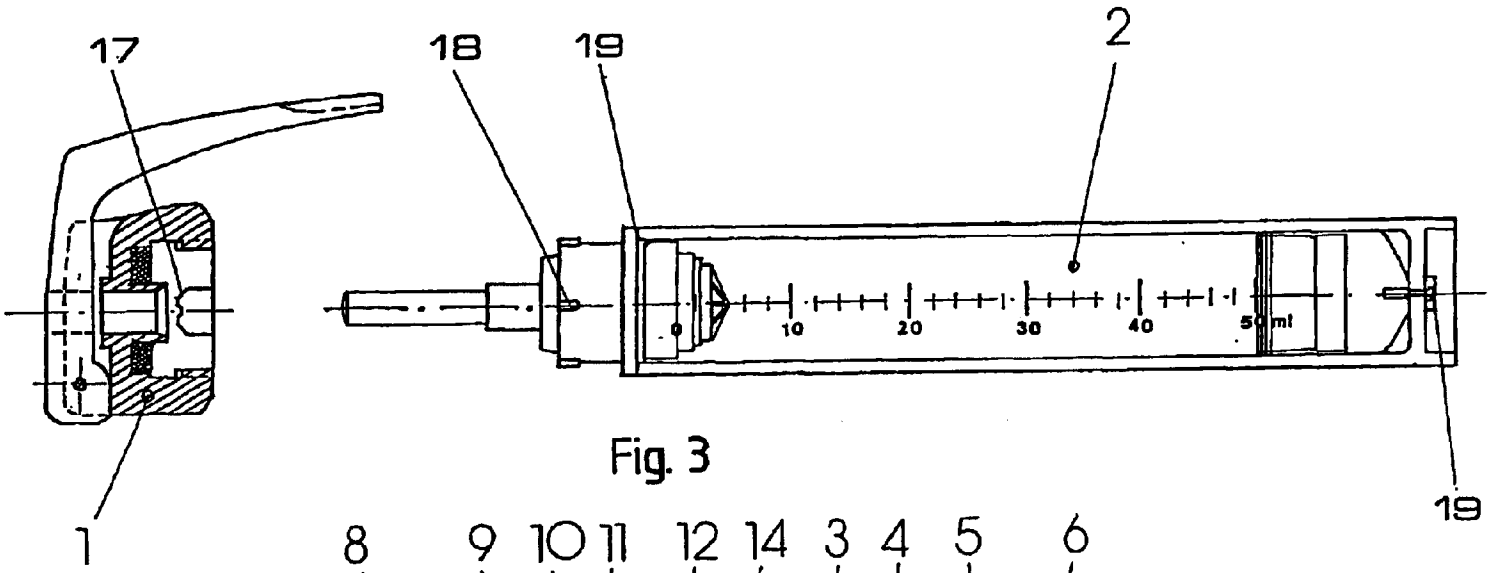

FIG. 3 The dispensing head and cartridge are shown disconnected. The cartridge is filled with "cream-like material. The dispensing head is shown in cross section and the cartridge is shown longitudinally. (The cartridge is transparent plastic.)

Figure 4:
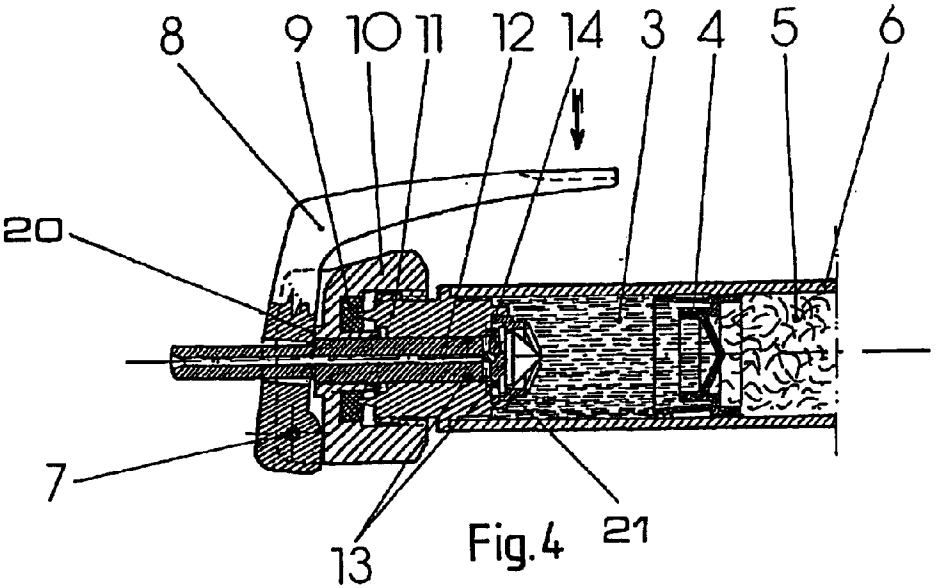

FIG. 4 The dispensing head and the cartridge are depicted connected, in cross section. The cartridge is filled up with "cream-like material".

Figure 5:
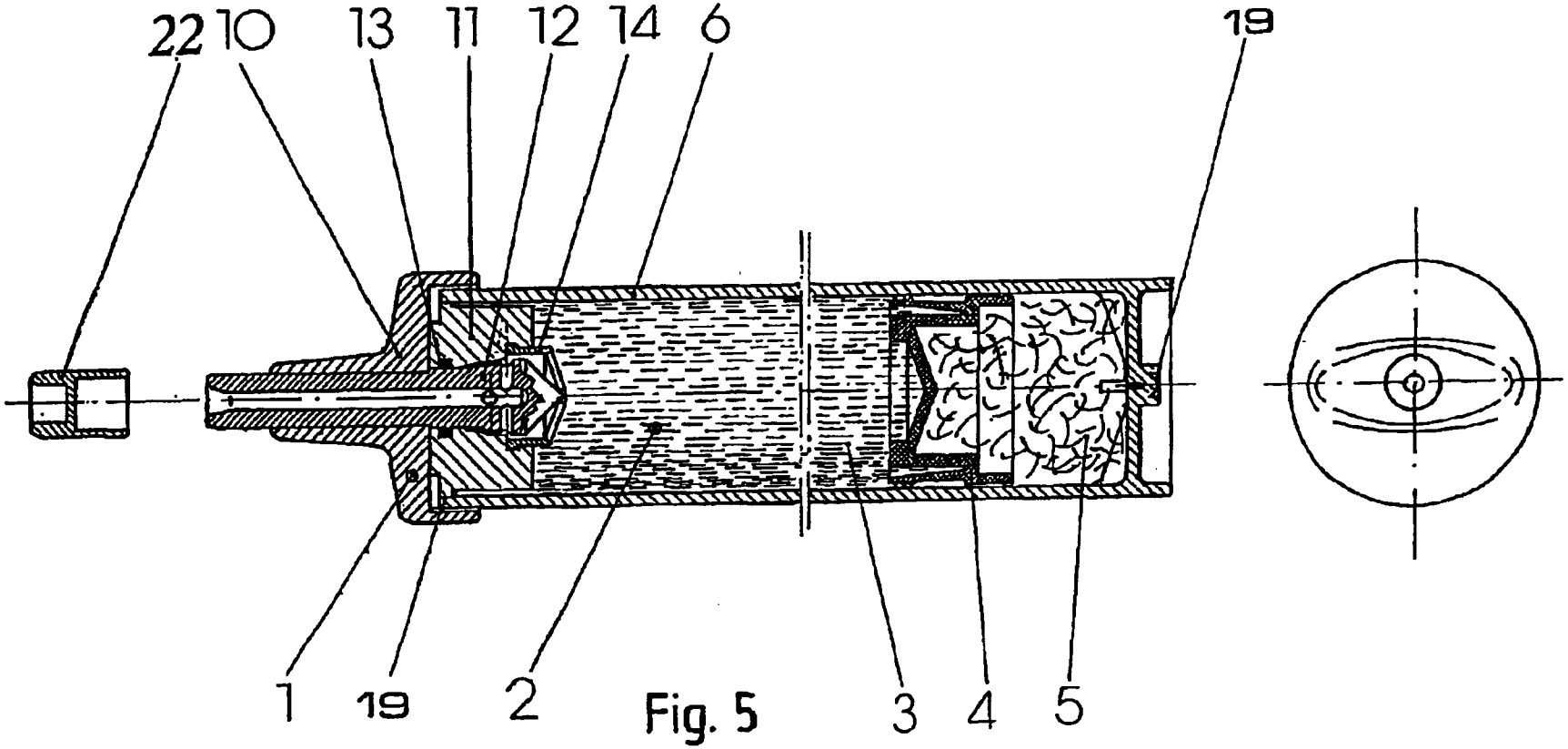

FIG. 5 The mouth formed dispensing head and the cartridge are shown connected, in cross section. The cartridge is filled with "foodstuff".

The main characteristic of the packaging system according to the invention is that it contains two separate units, the dispensing head 1 and the cartridges 2—which usually contain chemical industry products—that can be connected to it, the cartridges 2 have a valve built into them at the beginning, and inside it there is a product chamber 3, a piston 4 and a pressurised gas chamber 5. The dispensing head 1 and the cartridges 2 that may be connected to it have the same connection elements, which make it possible to quickly interchange the cartridges 2 containing the liquid and cream-like material and after the cartridge 2 has been disconnected the remaining liquid or cream is stored until its next use. On connecting through its central hole the dispensing head 1 is slipped onto the end of the valve stem 12 extending from the cartridge 2, at this time the conical edge formation on the valve house 11 end face is pushed into the rubber ring 9 that is inside the dispensing head 1, after this while rotating the cartridge the profile pair—of tapered profiles 17 and claw profiles 18—consisting of 3–4 elements fits together in such a way that the claw profiles 18 slip onto the tapered profiles 17 and progressing further the claw profiles 18 snap into the radial groove of the tapered profiles 17 as a result of the springing effect of the rubber ring 9. On disconnection on twisting the cartridge 2 it separates from the dispensing head 1. When connecting the opening and closing may take place in both directions of rotation.

The packaging system according to the invention is shown disconnected in FIG. 1 and connected in FIG. 2, in which case the product chamber 3 contains liquid and consists of the following elements: dispensing head 1, valve-opening lever 8 that moves on a cross pin 7, and the cartridge 2, which has a built-in valve and has liquid, a piston 4 and pressurised gas 5 inside it. After the dispensing head 1 and the cartridge 2 have been connected while the valve-opening lever 8 is being depressed its internal surface lies up against the bearing surface 20 of the valve stem 12, then the valve stem 12 moves in the axial direction and leaves the valve seat of the valve house 11 and through this there is a free path thorough which the liquid can pass. The pressurised gas 5 through the piston 4 exerts pressure on the liquid and due to this the liquid avoids the conical part of the valve stem 12 and gets into the atomisation chamber through the axial part, where it gets into the internal tangential grooves of the atomiser insert 16 and takes on spin energy, and after leaving the atomisation opening the liquid forms a conical shape and is atomised. On releasing the valve-opening lever 8 the disc spring 14 pushes valve stem 12 back to its resting position in the valve seat.

FIGS. 3 and 4 also show the packaging system according to the invention in a disconnected and connected arrangement, in this case the product chamber 3 contains cream-like material and the structural elements of these are a dispensing head 1, valve-opening lever 8 that moves on a cross pin 7, and the cartridge 2, which has a built-in valve and has cream-like material, a piston 4 and pressurised gas 5 inside it. After the dispensing head 1 and the cartridge 2 have been connected and after the valve-opening lever 8 has been depressed the valve stem 12 hits up against the inside surface 21 of the plastic disc spring 14 and blocks the path of the cream-like material in the cartridge 2 and by quickly releasing the valve-opening lever 8 only a small amount of material flows out of the discharge opening at the end of the valve stem 12. By depressing the valve-opening lever 8 only halfway the flow of the cream-like material is continuous. By completely releasing the valve-opening lever 8 the plastic disc spring 14 pushes the valve stem 12 back to its rest position. The cartridge house 6 may be made of transparent plastic, with ml markings.

Another construction form of the packaging device according to the invention is shown in FIG. 5, in which case the product chamber 3 contains foodstuff and consists of a mouth-shaped dispensing head and a cartridge 2, inside which there is foodstuff, a piston 4 and pressurised gas—at a low pressure. When using it first the closing cap has to be removed and temporarily pushed onto the end of the cartridge, then the mouth-shaped dispensing head is easily slipped onto the extended part of the valve stem 12 and then taking up the cartridge 2 into the hand, putting the dispensing head 1 into the mouth and exerting pressure in the direction of the cartridge 2, so opening the valve and then the foodstuff flows into the mouth cavity through the discharge opening at the end of the valve stem 12. On releasing the cartridge 2 the valve closes. The dispensing head 1 does not come into contact with the "foodstuff" in the cartridge. This example construction may be used to feed bed-ridden patients and infants. In the latter case it is recommended that the lever version of the valve opener be chosen and the side of the transparent cartridge house be inscribed with a scale so that the amount of food put into the infant's mouth can be controlled.

Beside the novel design of the invention it contains new construction elements which are not known consideration the present state of the art. One of them is the use of the plastic disc spring. This is contained in claim 1. Up till now steel springs have been used in valves. The other new element is the use of specially closing profiles in the case of connecting two parts. This is contained in claim 2.

LIST OF REFERENCES

1 dispensing head
2 cartridge
3 product chamber
4 piston
5 gas chamber
6 cartridge house
7 cross pin
8 valve-opening lever
9 rubber ring
10 dispenser house
11 valve house
12 valve stem
13 O-ring
14 disc spring
15 plug
16 atomiser insert
17 tapered profile
18 claw profile
19 plastic welding
20 bearing surface
21 inside surface
closing head

What is claimed is:

1. In a packaging unit for storing and dispensing of liquids, fluid and ductile materials, having a cartridge for the material to be stored and a pressurized gas operating with it, and a dispensing head connected to the cartridge, comprising a) a sliding piston (4) positioned within an internal chamber of said cartridge (2), b) said piston (4) divides the internal chamber of the cartridge (2) into a product chamber (3) and a pressurized gas chamber (5), and provides a gas-tight seal between said chambers, c) a plug (15) fitted into a gas chamber end of the cartridge (2)

d) a valve means fitted to a product chamber end of the cartridge (2), wherein e) said valve means has a valve house (11), a valve stem (12) being movably arranged in the valve house (11), and a disc spring (14) having plate segments, and f) a discharge opening at an end of said valve stem (12) protruding from the cartridge (2), and comprising g) a conical part of said valve stem (12) being arranged in the product chamber (3) of the cartridge (2), wherein h) said plate segments of the disc spring (14) are pushed against the conical part of said valve stem (12), i) the disc spring (14) is snapped onto a valve house (11), and comprising j) at least one O-ring arranged between the valve house (11) and the valve stem (12), k) a cartridge house (6) fixed to l) an outer mantle of the valve house (11).

2. The packaging unit according to claim 1, wherein between the dispensing head (1) and the cartridge (2) there are at least three connection element pairs assembled from a tapered profile (17) and a claw profile (18); said tapered profiles (17) and claw profiles (18) are tensioned towards one another by a rubber ring (9).

3. The packaging unit according to claim 1, wherein the dispensing head (1) and the cartridge (2) are connected to each other with a screw thread.

4. The packaging unit according to claim 1, wherein the dispensing head is coupled with a dispenser house (10), contains a valve-opening lever (8) that can be moved on a cross pin (7), the valve-opening lever (8) has an internal bearing surface, and this bearing surface touches the shoulder edge of the bearing surface (20) of the valve stem (12).

5. The packaging unit according to claim 1, wherein the dispensing head (1) has a form of a mouth.

6. The packaging unit according to claim 1, wherein the discharge pipe of the valve stem (12) contains an atomizer insert (16), that helps material in the liquid state to get out.

7. The packaging unit according to claim 1, wherein the discharge pipe of the valve stem (12) has a free nozzle that permits the flow of liquid and ductile material.

* * * * *